United States Patent [19]

Elliott

[11] 4,381,571

[45] May 3, 1983

[54] ADJUSTABLE ARTICULATED BED

[75] Inventor: Franklin E. Elliott, Torrance, Calif.

[73] Assignee: Maxwell Products, Inc., Cerritos, Calif.

[21] Appl. No.: 232,657

[22] Filed: Feb. 9, 1981

[51] Int. Cl.[3] ..... A61G 7/00

[52] U.S. Cl. ..... 5/66; 5/68

[58] Field of Search ..... 5/60, 66–69, 5/200, 201, 290

[56] References Cited

U.S. PATENT DOCUMENTS

| | | | |
|---|---|---|---|
| 1,511,882 | 10/1924 | Hadjieff | 5/290 |
| 1,658,776 | 2/1928 | Nixon | 5/69 |
| 1,658,777 | 2/1928 | Nixon | 5/69 |
| 3,644,946 | 2/1972 | Swatt | 5/68 |
| 4,110,856 | 9/1978 | Benoit et al. | 5/66 |

FOREIGN PATENT DOCUMENTS

| | | | |
|---|---|---|---|
| 855112 | 11/1960 | United Kingdom | 5/68 |

*Primary Examiner*—Francis K. Zugel

*Assistant Examiner*—Michael F. Trettel

*Attorney, Agent, or Firm*—Poms, Smith, Lande & Rose

[57] ABSTRACT

An adjustable articulated bed which may be disassembled for easy shipping in a small container and which is constructed from a minimum number of components is shown. The bed includes a frame, power drive module which nests within the frame and an articulated mattress. In one embodiment, the power drive module includes all necessary moving parts to form the articulated bed so that any frame may be used. In another embodiment, the power module includes all moving parts but for a pivotal linkage which mounts between the lower leg section of the articulated mattress and the frame. In either embodiment, the power module includes a pair of central support members which are separated by a lateral support. The lateral support is provided with a square cross section that aligns the central support members and drive motors mounted thereon. The pivot points are arranged in the two planes formed by the central support members for increased strength.

19 Claims, 6 Drawing Figures

ADJUSTABLE ARTICULATED BED

The present invention relates to an adjustable articulated bed and, more particularly, to a bed which consists of a frame and articulated mattress having a back, center, thigh and lower leg section which is mounted upon a power drive module for adjusting the articulated mattress.

BACKGROUND OF THE INVENTION

The concept of an adjustable bed is perhaps as old as man himself. That is, once man began sleeping in a bed he or she probably began sitting in that bed. It is a simple next step for the user of the bed who wishes to sit in it to reach for a pillow or other support for his or her back while remaining in a seated position.

Early adjustable beds were made from a sheet metal frame into three adjustable sections including a section for the back, seat and a straight section for the legs. Examples of adjustable beds which are capable of adjustment in but three sections are shown in U.S. Pat. Nos. 681,186 by Bowie; 1,001,437 by Payne; and 2,500,742 by Taylor.

It is generally uncomfortable to sit with your legs in a straight, elevated position. Thus, the next improvement in adjustable beds was to provide an articulated bed having four sections including two sections for the legs. Samples of such articulated beds are shown in U.S. Pat. Nos. 1,397,773 by Muir and 3,051,965 by Szemplak et al. A design utilizing a five sectioned articulated bed with a fifth section for the head is shown in design patent Des. 255,402 by Lundgren.

Whether an articulated bed utilizes three, four or five sections, the prior art provides several methods of adjusting the various sections including manual adjustment or adjustment by use by electrical motors. An example of a bed utilizing manual adjustment is shown in the U.S. Pat. No. 1,397,773 by Muir. A patent showing the use of two or more motors is shown in the U.S. Pat. No. 2,500,742 by Taylor. As the development of articulated beds advanced, it became common to utilize but a single motor with a differential drive or other arrangement to provide two or more adjustments from the single motor. An example of such a device shown in U.S. Pat. No. 2,349,701 by Buttikofer et al.

While adjustable beds are generally used in hospitals and other facilities which house invalids who are forced to spend extensive periods of time within a bed for reasons of health, injury or physical handicap, the advent of television has created a market for adjustable beds within the home. Thus, it is desirable to provide apparatus which may be inserted within a standard bed frame for providing the power necessary to adjust an articulated bed. An example of a device which may be inserted separately into a standard bed frame is shown in the U.S. Pat. No. 3,921,230 by Hanning et al.

Whether an articulated bed is to be used within a hospital, convalescent home or a private home, it is necessary to ship the bed from a facility where it was manufactured to a facility where it is to be used. Shipment of a large and bulky bed can create problems of handling, storage and cost. Shipment of such bulk also leads to mishandling and damage.

Further, most prior art adjustable beds have been designed with the thought that the beds would be utilized in a hospital. Such a bed was designed generally for long life and durability; while little attention was paid to value engineering to retain the desirable features while eliminating unnecessary parts, reducing costs, saving materials and improving operation.

SUMMARY OF THE INVENTION

Accordingly, it is an object of the present invention to provide an articulated bed which has fewer components, utilizes lighter components and is otherwise less expensive to manufacture.

Another object of the present invention is to provide a bed which may be disassembled for ease of storage and shipment.

A further object of the present invention is to establish a design for an adjustable articulated bed wherein the bed may be sold as either a kit of disassembled parts, as a major subassembly which incorporates the necessary moving components to power an articulated bed, or as a finished bed including the frame and an articulated mattress.

A still further object of the present invention is to provide an articulated bed which is strong enough to withstand shipping damage which might otherwise cause misalignment and premature wear of its moving parts.

In accomplishing these and other objects, there is provided an adjustable articulated mattress including a head, center, thigh and lower leg section which rests upon a power drive module that, in turn, nests within a bed frame. The power module is comprised of a pair of central support sections joined by a lateral support member which mounts a pair of motors that drive the adjustable support parts of the power drive module.

Each motor drives a gear train which, in turn, drives a threaded shaft that passes through a low friction bushing. The bushings are each pivotally attached to a cross member of an H-shaped torque arm that forms the support parts. The legs of the H-shaped torque arm form the lower most member of two structural parallelograms whose inner sides are formed by the outer ends of the center support sections and whose second sides are formed by a pair of pivot arms. The upper most portion of the parallelograms are is closed by horizontal support members.

Each adjustable support is formed with a structural parrallelogram on each side. There are two supports, one on each end of the central support sections, for supporting the back section and thigh section of the articulated mattress. As the motor is turned, the bushing travels along the threaded shaft for raising or lowering the structural parallelogram and the mattress section attached thereto.

Extending from the structural parallelogram which supports the thigh section of the articulated mattress is a second structural quadrilateral which supports the lower leg section thereof. The two structures are arranged to permit the lower leg section to flex and remain generally parallel with the plane of the floor while the thigh section is tilted at an angle thereto.

The upper edges of the central support sections have outwardly extending flanges which enable the power drive module to hang within any frame. The arrangement of the flanges also strengths the frame permitting a lighter frame should a specially designed frame be desired.

The power module thus described may be assembled from component parts which may be shipped in a relatively small container. The arrangement of the power module is specially designed to permit easy assembly and to assure alignment of that assembly once completed.

In another embodiment, the structural quadrilateral which mounts the lower leg section of the articulated mattress may be replaced by a lower leg support hinge which attaches to the outer edge of the structural parallelogram that supports the thigh section of the mattress. The lower leg support hinge supports but one edge of the lower leg mattress section, the second end being supported by a pivotal linkage which attaches from the second end to a cross member of the bed frame.

Another feature of the adjustable articulated bed is a low friction insert at each pivot point of each structural parallelogram to reduce noise and vibration and prolong life.

DESCRIPTION OF THE DRAWINGS

For a better understanding of the invention summarized above and of the objects and advantages presented thereby, the reader's attention is directed to the following specification and accompanying drawings, wherein.

DESCRIPTION OF THE PREFERRED EMBODIMENTS

Figure 1:
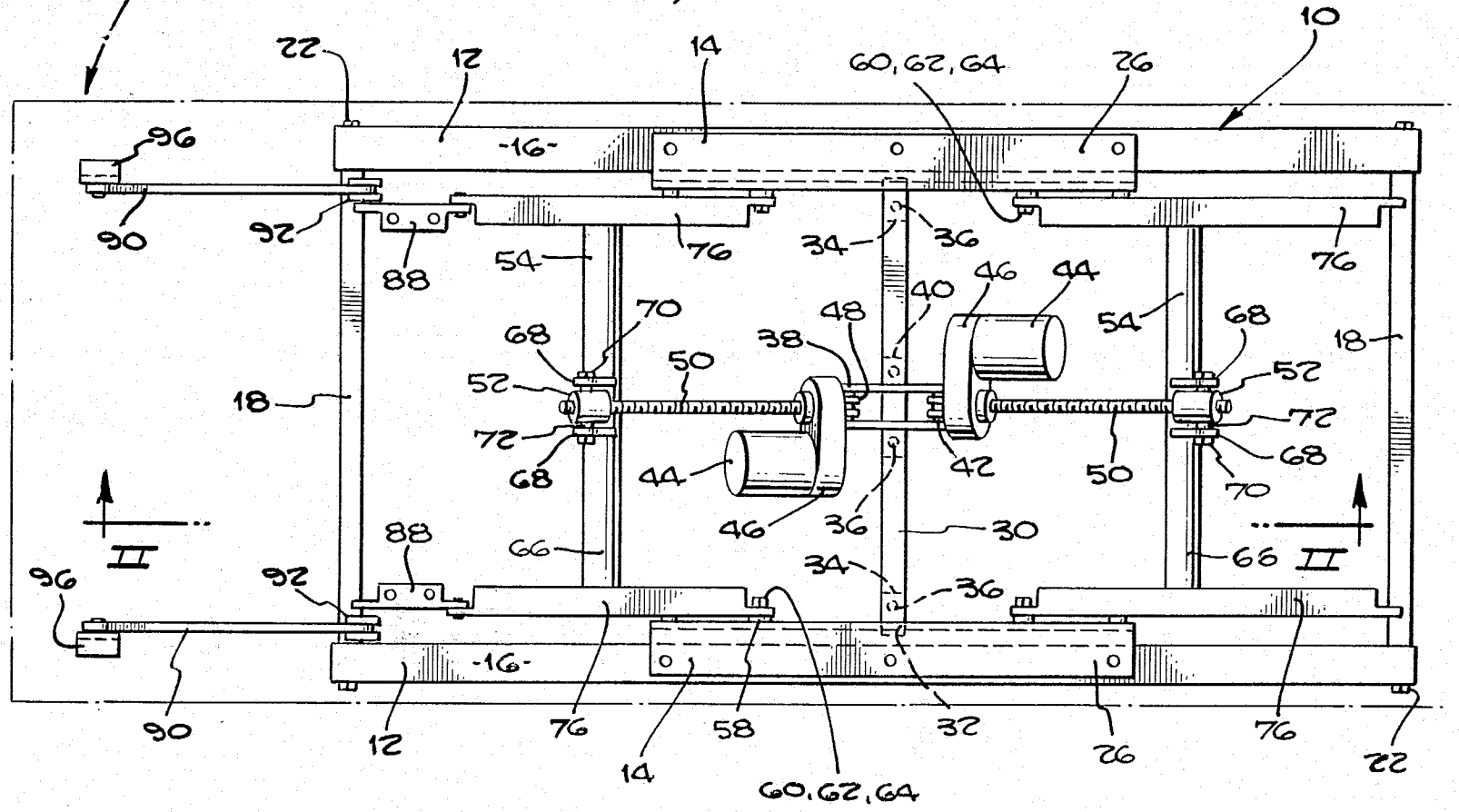
FIG. 1 is a top plane view of a power drive module nested in a frame of an adjustable articulated bed.

Referring now to the drawings, FIG. 1 shows an adjustable articulated bed 10 including a frame 12 and a power drive module 14 nested within the frame. The frame consists of two longitudinal supports 16 joined by two cross supports 18 which are the equivalent of a headboard and footboard in prior art beds. The opposite ends of the longitudinal supports 16 are bent at right angles to form vertical, frame support legs 20, FIG. 2. The lower portion of the vertical legs 20 may be provided with sockets or other suitable means for mounting casters, not shown, which assists in moving the bed from place to place. Each cross support 18 is attached to the longitudinal supports 16 by suitable nuts and bolts 22 and 24.

The power drive module 14 includes a pair of central support sections 26 that are L-shaped in cross section with the shorter legs thereof extending outwardly therefrom to land upon the longitudinal supports 16 of the frame 12. A tubular lateral support member 30 having a square cross section passes between the central support sections 26 for securing these sections in the power module 14 in a spaced, parallel relationship. The square cross section of the lateral support member 30 is inserted into a square aperture 32 found within each support member 26. In stamping the support members 26, the square aperture 32 is formed by a U-shaped stamp which bends the material removed from the square aperture at right angles to the surface of the support members to form tabs 34. The tabs 34 extends under the square cross section of lateral member 30 to support that member and align the central support sections 26 with that member. An aperture may be tapped in the support member 30 to receive a screw 36 for fastening each central support section 26 to the lateral member.

Mounted midway between the central support sections 26 are a pair of motor connecting plates 38 which have been stamped to produce a square aperture 39 whose material has been bent at a right angle to produce a tab 40 similar to tab 34. Again, the lateral support member 30 may be tapped to receive mounting screws 36 which secure the motor connectors to the support member 30. The motor connectors 38 are stamped in the shape of a rhombus having apertures at opposite ends through which a pin 42 may be inserted to pivotally mount motors 44. Each motor is provided with a gear train 46 having tabs 48 extending from its lower surface through which the pin 42 passes to provide the pivotal mounting. The gear trains drive threaded shafts 50 which pass through threaded, low friction bushings 52 which may be made from a moldable, low friction material such as nylon.

Figure 6:
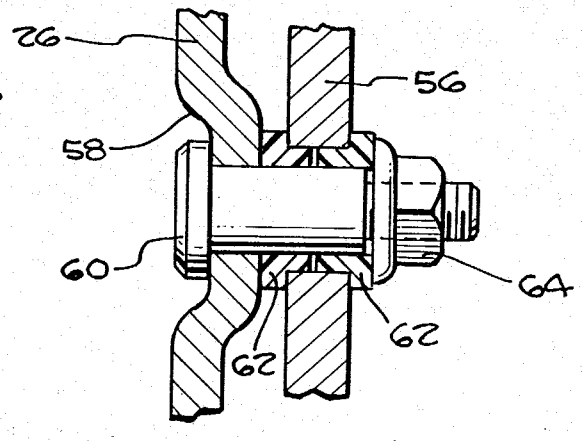
FIG. 6 is a detail showing a low friction pivot point used in the present invention.

Mounted to the lower outer corners of each of the central support sections 26 is one leg of an H-shaped torque arm 54. Each torque arm 54 is constructed from two triangularly shaped plates 56 whose inner end pivotally connects to the central support sections 26. The pivotal connection is accomplished by stamping a boss 58 into the central support section 26 to provide a raised anular surface against which the plate 56 may ride, FIG. 6. The boss 58 is drilled to provide an aperture into which is inserted a shouldered stud 60 which is retained therein by welding. The plate 56 is drilled to provide a larger aperture which receives a pair of shouldered, low friction bushings 62 through which the shouldered stud 60 is inserted so that the shoulders of bushings 62 assure the separation of the plate 56 from the boss 58. A self-locking flange nut 64 retains the plate 56 in place.

Between each plate 56 is welded a cross member 66 to complete the H-shaped torque arm subassembly. Extending perpendicularly from the center of the cross member 66 are a pair of bushing mounting tabs 68 which may be welded to the cross member 66 and which are provided with threaded apertures for receiving shouldered bolts 70 each having a reduced shouldered portion 72 that slidably fit into suitable apertures within the side wall of the bushing 52 to pivotally retain the bushing 52 between tabs 68.

Connected to the outer end of the triangular plates 56 which form the H-shaped torque arms 54 are a pair of upwardly extending pivot arms 74 which are pivotally attached to the plate 56 by use of the stud 60, bushing 62 and flange nut 64 as described above. Similarly, a pair of horizontal support members 76 are pivotly mounted about bosses 58 located in the upper, outer corners of the central support sections 26 by the use of the stud 60, bushing 62 and flange nut 64. In the positions shown, the horizontal support members 76 extend parallel with the central support sections 26. Pivotally connected to the horizontal support members 76 are the pivot arms 74 which are attached by the stud, bushing and jam nut 60, 62 and 64, respectively.

It will be seen from the foregoing description that the structural elements attached to each end of the central support section 26 form a parallelogram which may be raised when either motor 44 is energized for rotating the threaded shaft 50. Rotation of the threaded shaft 50 causes the bushing 52 to move along the longitudinal axis of the shaft 50 for rotating the H-shaped torque arm 54 about the pivot point located at the lower, outer ends of the central support sections 26. This causes the structural parallelogram formed by the members 56, 74 and 76 to rotate in an upward or downward direction with the members 56 and 76 remaining generally parallel to one another while the member 74 remains generally parallel to a line drawn between the pivot points located in the upper and lower corners of the central support sections 26.

The structural parallelograms thus described are found at the four corners of the power drive module 14 formed by the two central support sections 26 so that each moving section of the power module 14 is supported by two structural parallelograms. This provides added strength to the articulated bed.

Figure 2:
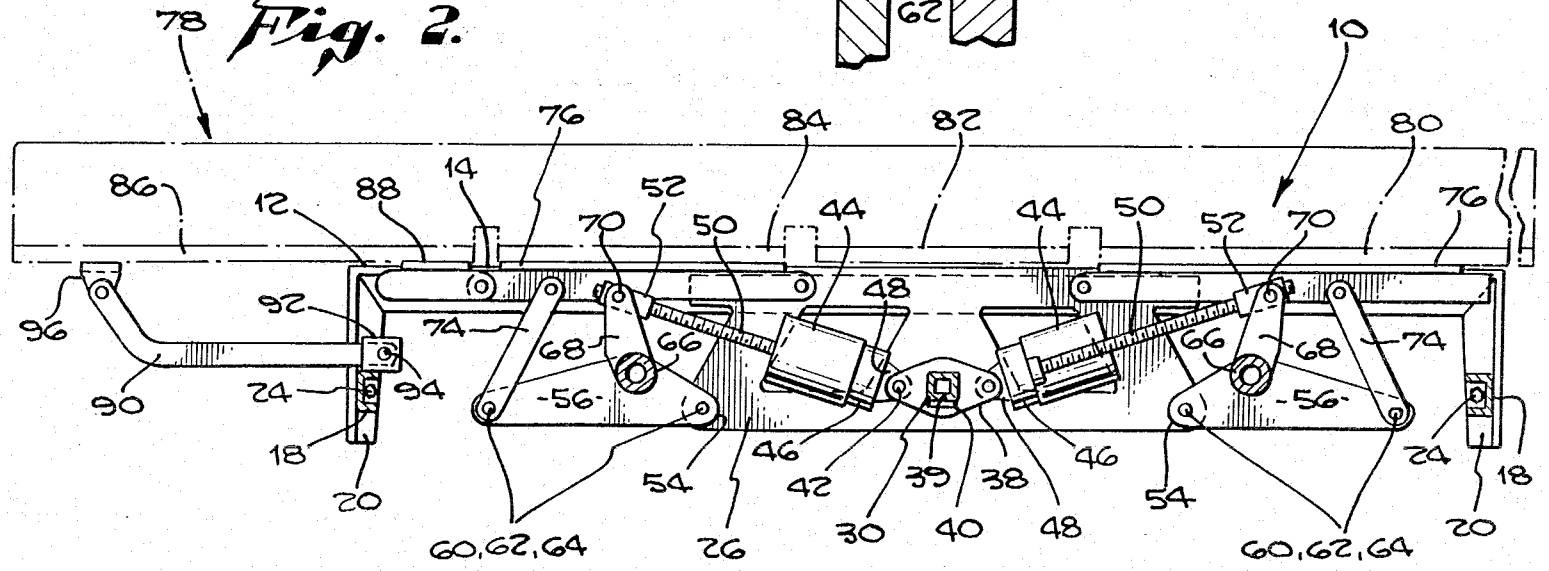
FIG. 2 is a cross sectional view of the power drive module taken along line II—II of FIG. 1 also showing an articulated mattress.

As seen in FIG. 2 an articulated mattress 78 may be formed from a plurality of sections. In the embodiment shown, the mattress is divided into four such sections including a back section 80, center section 82, thigh section 84 and lower leg section 86. The center section 82 mounts upon the center support sections 26 and is secured thereto by suitable screws, not shown. Similarly, the back section 80 mounts upon the right-hand horizontal support members 76 and is secured thereto by screws to form a back raising section while the thigh section 74 mounts upon the left-hand horizontal support members 76 that form the leg rising section of the power drive module 14.

Figure 3:
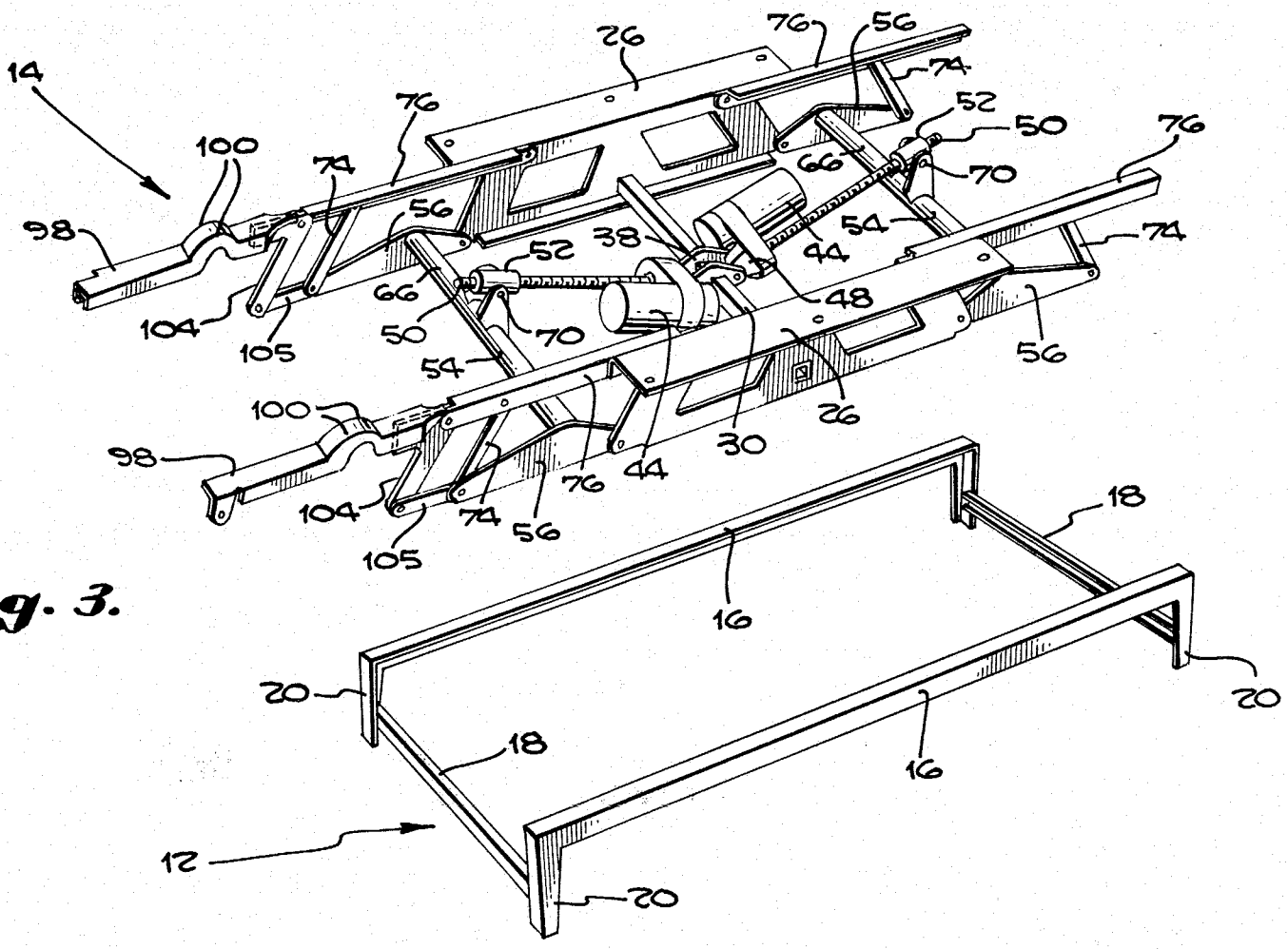
FIG. 3 is an exploded perspective view showing the power drive module and the frame embodying a structural quadrilateral for lifting the lower leg section of the articulated mattress.

As seen in FIGS. 1–3, there are two embodiments within the present invention for raising and lowering the lower leg section 86 of the mattress. The first embodiment, shown in FIGS. 1 and 2 comprises a lower leg support hinge 88 which is pivotally attached to the outer and of the horizontal support member 76. This hinge is secured to the lower leg section 86 of the mattress 78, by screws, not shown. The far end of the lower leg section 86 is supported by a pair of J-shaped pivotal linkages 90 that are removably mounted upon the cross support 18 of the frame 12 by a U-shaped hinge element 92 which receives the pivotal linkages 90 between the upwardly extending legs and retains them by use of hinge pins 94. An L-shaped pivot hinge 96 is mounted at the end of the short leg of each J-shaped linkage to attach the outside edge of the mattress section 86 for completing the assembly of the articulated bed.

As seen in FIG. 3, an alternate embodiment for raising and lowering the lower leg mattress section 86 includes a structural quadrilateral comprising a new set of linkage members. It will be understood that the first structural parallelogram which raised the back section of the mattress and the second structural parallelogram which raised the thigh section of the mattress are constructed from parts that are identical but for their length. The structural quadrilateral is constructed from slightly different parts.

A horizontal support 98 extends from a pivot point located in approximately the same location as the pivot point of the hinge 88. Each horizontal support 98 is an inverted channel with a wide center portion to permit the stamping of two arcuate sections 100 which are bent into vertical arches when the sides of the channel are formed. The inner curves of the arcuate sections 100 form a clearance for a skirt 102, FIG. 5, which may be mounted about the vertical legs 20. The outer curves of the arcuate sections 100 are inserted into suitable slots, not shown, in the lower surface of the lower leg section 86.

Mounted between the sides of channel 98 is a L-shaped pivot member 104 which may be welded to the channel to form the horizontal support into an L-shape. At the lower end of member 104, a pivot arm 105 is pivotally mounted for connection to the jointure of the plate 56 and the upwardly extending arm 74. It will now be noted that the channel 98, member 104 and arm 105 form a four sided structural member with but three pivot points. These structural members on each side of the lower leg mattress are thus referred to as guadrilaterals rather then parallelograms.

When the third structural quadrilateral is utilized, it is not necessary to use the pivotal linkages 90 as shown in FIGS. 1 and 2. The arrangement of FIG. 3 permits the power module 14 to be nested in any frame 12. All that is required is that the outwardly extending short leg of the L-shaped central support sections 26 properly engage the top of the suitable frame 12.

Figure 4:
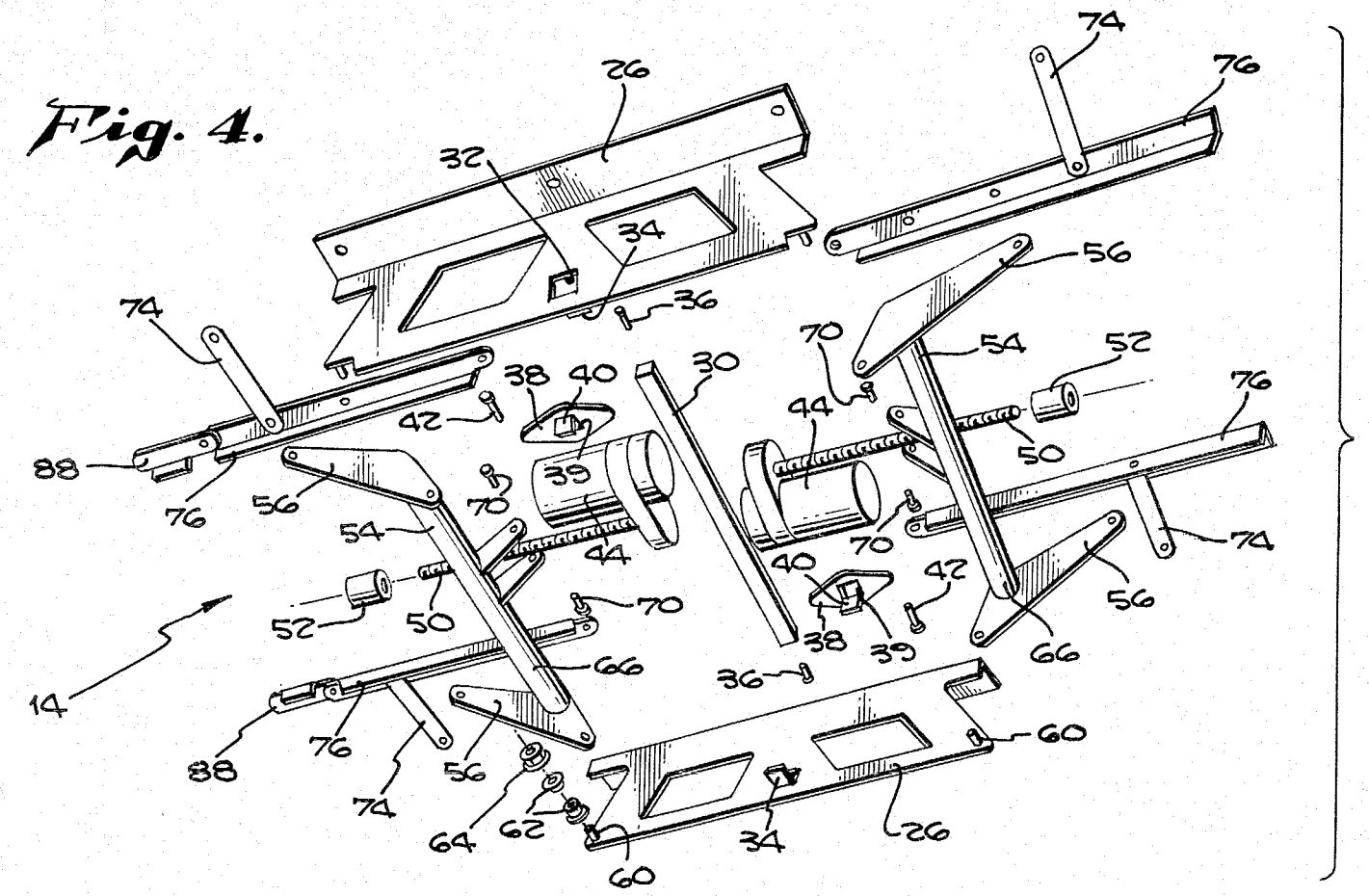
FIG. 4 shows the power drive module of the present invention disassembled for packing and shipping.

As best seen in FIG. 4, the power module 14 may be fully disassembled for easy storage, packaging, and shipping. Note that the square lateral support member 30 fits into the apertures 32 of each central support section 26 for aligning these sections. The screws 36 through tabs 34 secure the lateral support member 30. Similarly, the square apertures 39 in motor connectors 38 which form tabs 40 permit the connectors 38 to be positioned and properly aligned upon the lateral support 30.

The studs 60 welded to the corners of the central support sections 26 further permit easy assembly of the H-shaped arms 54 which are then secured by the bushings 62 and flange nuts 64. The shouldered bolts 70 also fit smoothly into the threaded apertures within tabs 68 and the apertures in bushings 52 for conveniently attaching the motors 44 and threaded shafts 50 to the cross member 66 of H-shaped torque arms 54. It should be noted that each pivot point includes the stud 60, bushing 62 and nut 64 so that each joint may be quickly and easily assembled for a smooth pivotal operation with no metal to metal contact.

While the embodiment shown in FIG. 4 includes the hinge elements 88 which combine with the J-shaped pivotal linkages 90 to support the lower leg mattress section 86, it will be understood that the pivot arm elements 98, 104 and 105 may be also utilized. When the hinge 88 is used, it is necessary to provide a cross support 18 upon which to mount the pivotal linkages 90 in the U-shaped hinge supports 92. In this arrangement, it is necessary to modify the frame from a standard frame utilizing standard components. However, should the embodiment shown in FIG. 3 be utilized, the power module 14 may be inserted into any suitable frame. Thus, the power drive module 14 may be disassembled and shipped in a relatively small container to distant points, reassembled and then inserted into a standard frame to provide the adjustable articulated bed of the present invention. Prior to the present invention, it was not possible to provide an articulated bed by simply shipping a disassembled power drive module 14.

Figure 5:
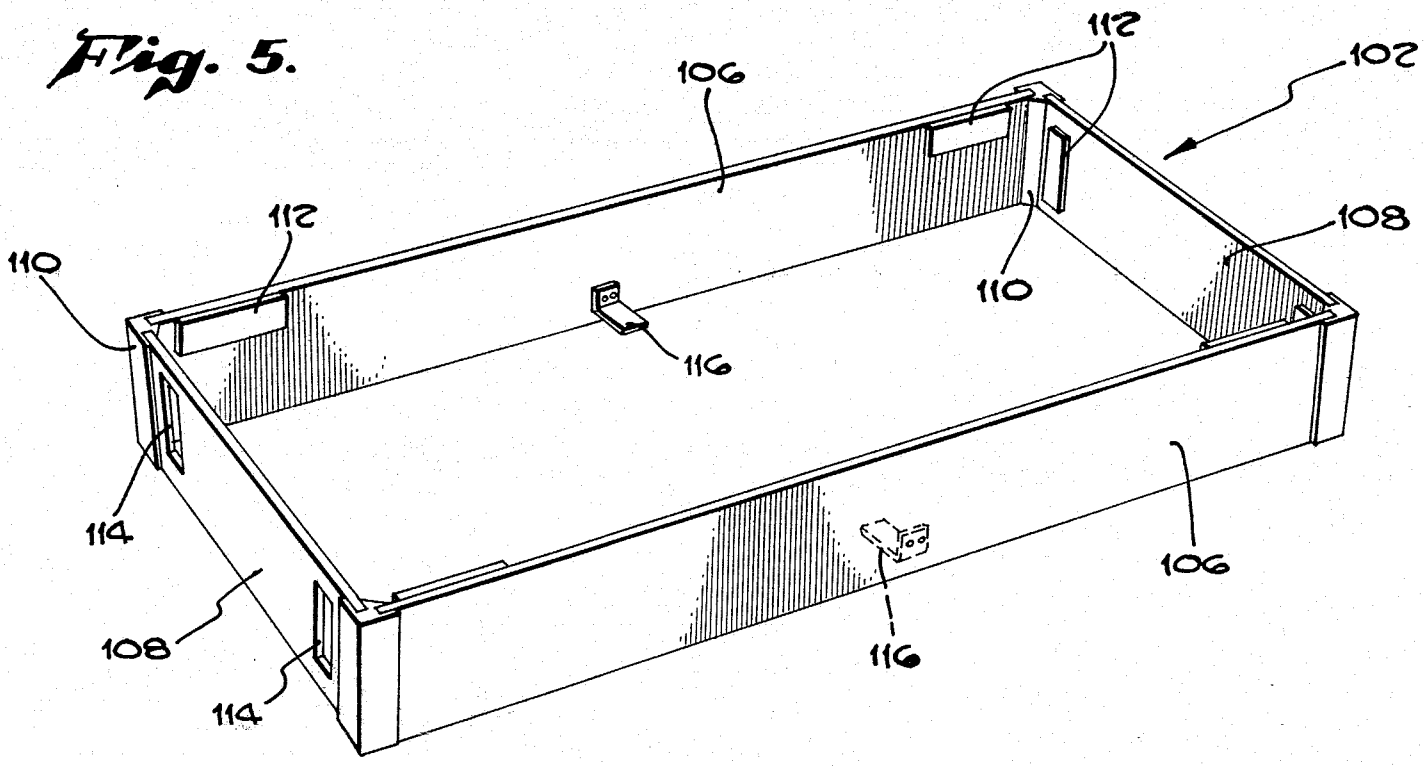
FIG. 5 shows a skirt which may be mounted about the frame of the articulated bed.

Referring now to FIG. 5, an optional skirt 102 is shown which may be mounted about the legs 20 of the frame 12. The skirt 102 comprises two longitudinal members 106 and two cross members 108 which correspond to the headboard and footboard of a standard bed. The members are joined by an extruded member 110 having inner and outer legs and a 90° offset for receiving each end of the longitudinal and cross members, 106 and 108. The longitudinal and cross members may be made from wood or composition board having a grained covering. The members may also be made from metal or even polished metal mirrors for various decorative touches. The skirts are provided with resilient, vibration absorptive pads 112 which may, for example, be constructed from particle board. These pads serve to mount the longitudinal and cross members 106 and 108 to the frame 12 and further serve to isolate the skirt from vibration or noise.

When the embodiment shown in FIGS. 1 and 2 is utilized, the cross member 108 of skirt 102 is provided with a pair of extended apertures or slots 114 through which the pivotal linkages 90 may be passed. After the linkages have been inserted through he slots 114, the U-shaped hinge support 92 is attached for attaching the linkages to the cross member 18 of the frame 12. In the prior art skirt arrangements which require similar slots, the slots 114 extend through the periphery of the cross member 108 which weakens that member. A better arrangement is to provide hinges 92 which may be removed from the ends of the pivotal linkages 90 thus permitting the insertion of linkages through the apertures 114. This provides a stronger skirt member 102, less subject to vibration. Angles 116 are provided on the lower edge of the longitudinal members 106 to attach these members to the lateral support member 30 of power module 14. This secures the skirt 102 to the module 14 for further reducing vibration. When the embodiment shown in FIG. 3 is utilized, the cross member 108 requires no slots.

By referring to FIGS. 2, 3, and 4, it will be apparent that this replacement of parts is but a simple matter of removing an identified number of parts and, in place thereof, assemblying the desired parts. Thus, it will be seen that the construction of the power drive module 14 from a plurality of subassemblies lends itself to the concept of stocking but a limited member of parts while permitting a distributor to offer many variations to its customers.

It will be noted from FIG. 3 that the power drive module 14 provides a substantial amount of support to the frame 12. That is, the short leg of the L-shaped central support sections 26 lays along the upper surface of the longitudinal support member 16 of frame 12. Once bolted thereto, the central support sections 26 substantially strengthen the supports 16. This added strength is provided with fewer parts than known in the prior art. Further, the two central support sections 26, about which all pivotal motion is centered, add to the structural integrity of the adjustable articulated bed. Each pivot point formed by the stud 60, bushing 62 and flange nut 64 is found within the plane of the central support sections 26. Each pivot point is also supported from at least two angles so that a triangular support is achieved rather than a cantilevered support of a pivot point, as in the prior art.

Once assembled, the arrangement shown in the FIGS. 1–6 discussed above is relatively free from misalignment problems caused by mishandling or dropping during shipment or moving. The articulated bed described above may be sold as separate individual pieces to a bedding manufacturer who wishes to provide a suitable frame and mattress and other structural elements. Alternately, the be may be sold in the form of an assembled power drive module 14 or sold as a power module and shipped in a disassembled fashion as illustrated in FIG. 4. Finally, the full bed assembly may be sold including a frame 12, power module 14 and mattress 78, as described in FIG. 3. Other modifications will become apparent to those skilled in the art; and, therefore, the present invention should be limited only be the appended claims.

I claim:

1. An adjustable articulated bed having a separate power drive module which may be assembled and disassembled for compact storage, shipment and handling, comprising:

a frame;

an articulated mattress;

said separate power drive module removably nested within said frame to support said articulated mattress;

a pair of central support sections forming the side supports of said power drive module each having an aperture therein whose periphery is provided with an alignment flat;

a lateral support member having a flatted cross section passing through said apertures in said central sections for joining said central sections in alignment with said flats and in parallel alignment with each other;

connecting means having an aperture therein whose periphery is provided with an alignment flat through which said lateral support member passes for aligning said connecting means with said pair of central sections; and drive motor means mounted upon said connecting means in alignment with said central sections of said power drive module.

2. An adjustable articulated bed, as claimed in claim 1, wherein:

said apertures in said connecting means and said central support sections are square apertures; and said lateral support member has a square cross section.

3. An adjustable articulated bed, as claimed in claim 1, wherein:

said central support sections are formed with an L-shaped cross section, the short leg of which extends out from the upper sides of said power module formed by said central support sections to hang said module from said frame and thereby strengthen said frame where said side sections hang therefrom.

4. An adjustable articulated bed, as claimed in claim 1, additionally comprising:

said articulated mattress having a back, center and leg section;

said pair of central support sections supporting said center section of said mattress;

back supporting means pivotally mounted to one end of each said central support sections to support said back section of said mattress;

leg supporting means pivotally mounted to the other end of each of said central support sections to support said leg section of said mattress;

said back and leg supporting means each including:

an H-shaped torque arm having two legs and a cross member whose legs are pivotally connected at one end to the lower corner of said central support sections;

a pair of upwardly directed pivot arms connected pivotally to the opposite ends of said legs of said H-shaped torque arm;

a pair of horizontal support members each connected pivotally at one end to said upwardly directed pivtor arms and pivotally connected at the other ends thereof to the upper corners of said central support sections wherein the outer ends of said back and leg support means form a structural parallelogram;

said cross member of said H-shaped torque arm having an extension arm; and said drive motor means connected to said extension arm for raising said structural parallelogram found by said H-shaped torque arm, said pair of pivot arms and said pair of horizontal support members to raise an associated section of said articulated mattress.

5. An adjustable articulated bed, as claimed in claim 4, additionally comprising:

said leg section of said articulated mattress including a thigh and lower leg section;

said leg support means including a lower leg support frame having pivotal joints formed as a structural quadrilateral attached to said pivot point between said H-shaped torque arm and said pair of pivot arms and to said horizontal support member beyond said pivot point between said pair of pivot arms and said pair of horizontal support members to support said lower leg section of said mattress.

6. An adjustable articulated bed, as claimed in claim 5, wherein said structural quadrilateral includes:

a second pair of pivot arms pivotally attached to said pivot point between said pair of first mentioned pivot arms and said H-shaped torque arms;

a pair of L-shaped support arms pivotally attached to pivot points at the end of said second pair of pivot arms and further pivotally attached to said horizontal support members beyond said pivot point between said first mentioned pair of pivot arms and said pair of horizontal support members; and said lower leg section of said articulated mattress is supported upon the longer legs of said pair of L-shaped pivot arms.

7. An adjustable articulated bed, as claimed in claim 6, additionally comprising:

a skirt enclosing said frame;

said longer legs of said pair of L-shaped pivot arms having arcuate sections which extend into said lower leg section of said mattress to provide clearance for said skirt.

8. An adjustable articulated bed, as claimed in claim 4, additionally comprising:

said leg section of said articulated mattress including a thigh and lower leg section;

said leg support means further including a lower leg support hinge pivotally attached to said horizontal support members beyond said pivot point between said pair of pivot arms and said pair of horizontal support members to support said lower leg section; and a pivotal linkage pivotally joining said lower leg section to said frame to further support said lower leg section.

9. An adjustable articulated bed, as claimed in claim 8, additionally comprising:

said pivotal linkage removably mounted to said frame;

a skirt enclosing said frame having an elongated apertures through which said pivotal linkage may pass to support said lower leg support means wherein said skirt is provided with a solid periphery uninterrupted by apertures to weaken said skirt.

10. An adjustable articulated bed, as claimed in claim 4, additionally comprising:

a pair of drive motors pivotally mounted upon said connecting means, one motor connected to drive said back supporting means and the other motor connected to independently drive said leg supporting means.

11. An adjustable articulated bed, as claimed in claim 1, additionally comprising:

a skirt enclosing said frame, stand off means mounted between said frame and said skirt constructed from an absorbent material to mechanically isolate said skirt from said frame thereby reducing noise and vibration as said articulated bed is adjusted.

12. An adjustable articulated bed, as claimed in claim 4, additionally comprising:

mechanical insulating bushings inserted at each pivotal connection of said back and leg support means fastened by bolt and self-locking nut means to reduce noise and vibration as said articulated bed is adjusted and to aid in the assembly and disassembly thereof.

13. A power drive module for an adjustable articulated bed that may be assembled and disassembled and nested in a bed frame for adjusting an articulated mattress which includes back, center, thigh and lower leg sections, comprising:

a pair of central support sections having apertures therein whose periphery is provided with an alignment flat;

a lateral support member having a flatted surface which aligns and joins said central support sections to form the sides of said power module;

said central support sections having hanging means for supporting said power drive module upon said frame;

back supporting means pivotally attached to one end of said central support sections for supporting said back section of said articulated mattress;

said central support sections supporting said center section of said articulated mattress;

thigh supporting means pivotally attached to the other end of said central support sections for supporting said thigh section of said articulated mattress;

lower leg supporting means pivotally attached to the end of said thigh supporting means opposite the end thereof attached to said central support sections for supporting said lower leg portion of said articulated mattress;

connecting means having apertures therein whose peripheries are provided with an alignment flats aligned by and mounted on said lateral support member; and motor means pivotally mounted upon said aligned connecting means between said central support sections for raising and lowering said back supporting means and said thigh supporting means wherein the raising of said thigh supporting means raises said lower leg supporting means, for adjusting said articulated mattress independent of said frame.

14. A power drive module for use in an articulated adjustable bed that may be assembled and disassembled and mounted within a bed frame for support of an articulated mattress having back, center and leg sections, comprising:

a pair of central support sections forming the side support for said power drive module to support said center section of said mattress having apertures therein whose periphery has an alignment flat;

a lateral support member having at least one alignment flat connecting said central support sections and forming the cross support for said power drive module;

back support means pivotally mounted to one end of each of said central support sections to support said back section of said mattress;

leg support means pivotally mounted to the other end of each of said central support sections to support said leg section of said mattress;

said pivotally mounted back and leg support means mounted at more than one pivot point to said pair of central support section to strengthen said power drive module;

connecting means having apertures therein with alignment flats for aligned mounting upon said later support member;

drive motor means pivotally connected to said connecting means for driving said back and leg support means; and said pivotally mounted back and leg support means free of any mounting upon said bed frame whereby any bed frame may be used to create an adjustable bed.

15. A power drive module, as claimed in claim 14, wherein said alignment means includes:

said central support sections and said connecting means having square apertures therein for receiving said later support member; and said lateral support member having a square cross section for passage through said square apertures.

16. A power drive module, as claimed in claim 14, wherein:

said central support sections are L-shaped having the short leg of said L extending outwardly to hang upon said bed frame strengthening said frame.

17. A power drive module, as claimed in claim 14, wherein:

said pivot points between said pair of central support sections and said back and leg sections are all aligned within the plane of each of said central support sections and are each supported from at least two directions for additional strength.

18. A power drive module, as claimed in claim 16, additionally comprising:

said leg section of said articulated mattress having a thigh and lower leg section;

a lower leg support means pivotally mounted to said leg support means to support said lower leg section of said mattress;

said lower leg support means including a pair of support arms having an arcuate section which extends into said leg section of said mattress; and a skirt enclosing said frame and fitting within said arcuate section of said pair of support arms wherein said power drive module nests within said skirted frame without modification thereof.

19. An adjustable articulated bed comprising:

a frame;

an articulated mattress;

a separate power drive module removably nested within said frame to support said articulated mattress;

a pair of central support sections forming the side supports of said power drive module each having an aperture therein whose periphery is provided with an alignment flat;

a lateral support member having a flatted cross section passing through said apertures in said central sections for joining said central sections in parallel alignment with said flats;

a skirt enclosing said frame; and stand off means mounted between said frame and said skirt constructed from an absorbent material to mechanically isolate said skirt from said frame thereby reducing noise and vibration as said articulated bed is adjusted.

* * * * *